US006505541B2

(12) United States Patent
Skirde et al.

(10) Patent No.: US 6,505,541 B2
(45) Date of Patent: Jan. 14, 2003

(54) COOLING ARRANGEMENT FOR AN INCLINED-AXIS VARIABLE DISPLACEMENT UNIT

(75) Inventors: Eckhard Skirde, Aukrug-Boken (DE); Vladimir Galba, Nova' Dubnica (SK)

(73) Assignee: Sauer-Danfoss, Inc., Ames, IA (US)

( * ) Notice: Subject to any disclaimer, the term of this patent is extended or adjusted under 35 U.S.C. 154(b) by 0 days.

(21) Appl. No.: 09/948,985

(22) Filed: Sep. 7, 2001

(65) Prior Publication Data

US 2002/0152887 A1 Oct. 24, 2002

(30) Foreign Application Priority Data

Sep. 11, 2000 (DE) ..... 100 44 785

(51) Int. Cl.[7] ..... F01B 3/00; F01B 13/04
(52) U.S. Cl. ..... 92/12.2; 91/505
(58) Field of Search ..... 92/12.2; 91/504, 91/505, 506

(56) References Cited

U.S. PATENT DOCUMENTS

| | | | | |
|---|---|---|---|---|
| 2,661,701 A | * | 12/1953 | Ferris | 91/506 X |
| 3,277,835 A | * | 10/1966 | Wahlmark | 91/506 X |
| 3,760,692 A | * | 9/1973 | Molly | 91/505 |
| 3,827,337 A | * | 8/1974 | Pruvot | 91/506 X |
| 4,253,381 A | * | 3/1981 | Wartelle | 91/506 |
| 4,593,604 A | * | 6/1986 | Poletti | 91/504 |

* cited by examiner

*Primary Examiner*—Edward K. Look
*Assistant Examiner*—Michael S Leslie

(57) ABSTRACT

An inclined-axis variable displacement unit has an output shaft (1), mounted in a housing (4), and a cylinder block (10), the cylinder block (10) being connected to the output shaft (1) via a synchronizing articulation (13), and via working pistons (11) which can be displaced in the cylinder block (10), and the cylinder block (10) being mounted in a pivoting body (5) which can be pivoted in relation to the axis of the output shaft, it being the case that the pivoting body (5) is in the form of an open vessel, and the cylinder block (10) is arranged in the opening of the pivoting body.

17 Claims, 5 Drawing Sheets

COOLING ARRANGEMENT FOR AN INCLINED-AXIS VARIABLE DISPLACEMENT UNIT

FIELD OF THE INVENTION

The invention relates to an inclined-axis variable displacement unit or an axial piston machine of inclined-axis construction.

The generally known operating principle of such machines is based on an oil-volume stream being converted into a rotary movement.

BACKGROUND OF THE INVENTION

A cooling arrangement is particularly important in axial piston machines of inclined-axis construction, in particular when relatively high levels of power are to be transferred. Insufficient cooling adversely affects the service life since the signs of wear increase at high operating temperatures. Moreover, with improved cooling, higher rotational speeds and larger maximum external diameters of the bearings are possible, these factors being of considerable importance as far as the service life of axial piston machines is concerned.

Axial piston machines of inclined-axis construction in which the bearings are cooled by oil which is located in the housing of the machine are already known. The oil here is fed on by a pump effect which is produced by the rotation of the roller mounting. A disadvantage of this solution, however, is that it is essentially only the oil which is located in the immediate vicinity of the mounting and is already at elevated temperature which is circulated. Moreover, this oil has already cooled other internals of the machine beforehand, with the result that the viscosity has already been reduced, an elevated oil temperature resulting in a reduction in the viscosity.

Patent DE-A-196 49 195 discloses a cooling arrangement for an axial piston machine in which the operating medium is guided, from a low-pressure branch of the main circuit of the motor, through a cooling channel which extends in the central part of the cylinder block and along the axis of rotation of the shaft. A disadvantage of this solution, however, is that the oil is likewise heated en route to the bearings in the central part of the motor. Moreover, this arrangement of a cooling channel restricts the throughflow cross section to a considerable extent, with the result that the quantity of oil flowing through for cooling is vastly reduced.

Finally, Patent DE-A-198 29 060 discloses a means for cooling an axial piston machine in which the oil used as coolant is introduced directly at the mounting. The coolant then passes through the mounting into the housing interior, in which the cylinder drum is located. In this case, a branch line runs from the coolant stream along the axis of rotation of the shaft and then through the central part of the cylinder block. However, this line, rather than being provided for cooling purposes, is only provided for lubricating the synchronizing articulation.

The principal object of the present invention is to provide an inclined-axis variable displacement unit or an axial piston machine of inclined-axis construction in which the service life is increased.

This object is achieved by an inclined-axis variable displacement unit or an axial piston machine of inclined-axis construction.

SUMMARY OF THE INVENTION

An inclined-axis variable displacement unit has an output shaft (1), mounted in a housing (4), and a cylinder block (10), the cylinder block (10) being connected to the output shaft (1) via a synchronizing articulation (13), and via working pistons (11) which can be displaced in the cylinder block (10), and the cylinder block (10) being mounted in a pivoting body (5) which can be pivoted in relation to the axis of the output shaft, it being the case that the pivoting body (5) is in the form of an open vessel, and the cylinder block (10) is arranged in the opening of the pivoting body.

DESCRIPTION OF THE PREFERRED EMBODIMENT

Figure 1:
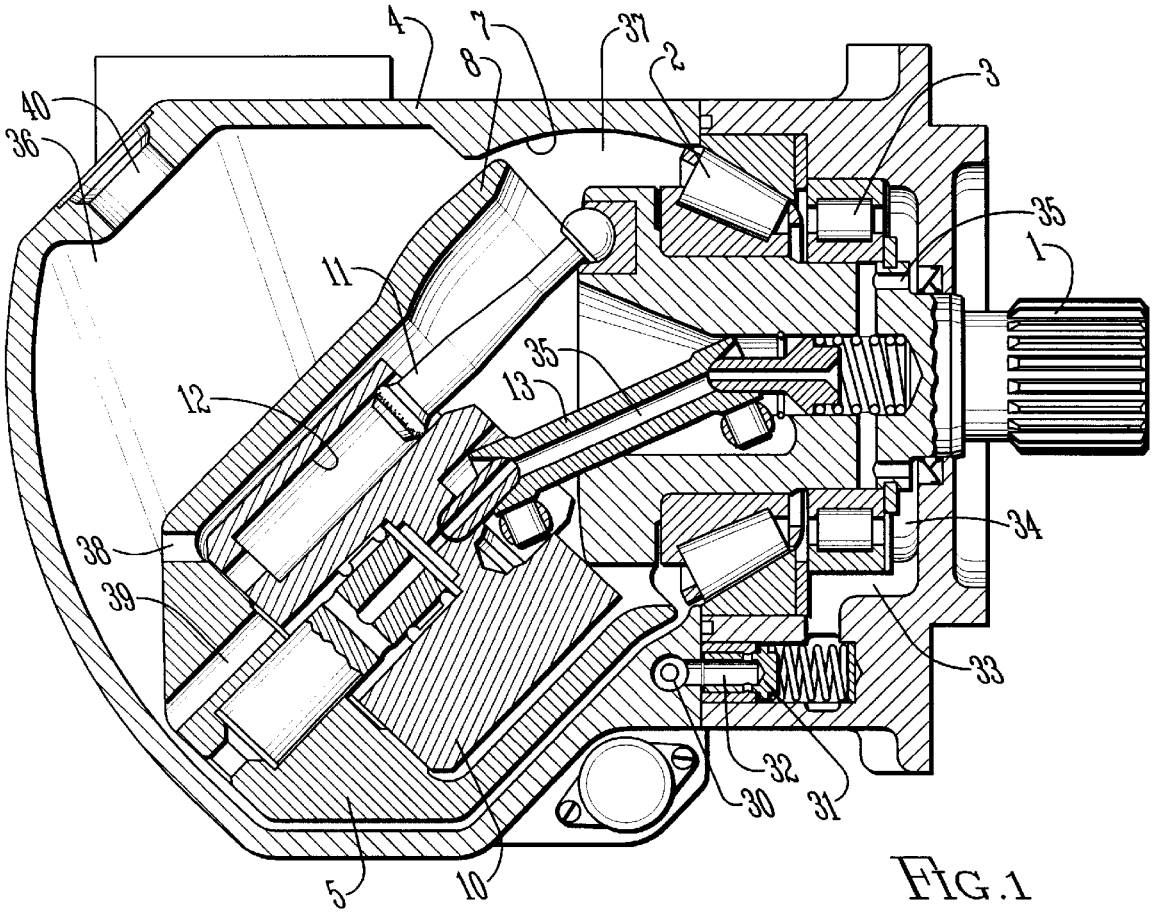
FIG. 1 shows a cross section of the cylinder block and of the inclined-axis variable adjustment unit according to the invention in the plane defined by the axis of the output shaft, said cross section illustrating the course taken by the central cooling channel and the coolant guide space.

FIG. 1 illustrates a housing 4 of the unit, within which a pivoting body 5 is mounted. Located within the pivoting body 5, in turn, is a cylinder block 10, which is mounted axially in the pivoting body 5. The cylinder block 10 is connected to the shaft 1 via synchronizing articulation 13. The shaft 1 is mounted in the housing 4 with the aid of rolling-contact bearings 2 and 3, although it is also possible to provide slide bearings. The shaft 1 is connected to a group of working pistons 11, which are mounted displaceably in cylinder openings 12 of the cylinder block 10.

The cylinder block 10 is mounted pivotably in the housing 4 with the aid of an axial pivoting body 5. The mounting of the pivoting body 5 and the supply of the oil into the cylinder block are described in more detail hereinbelow.

The operating fluid passes from a low-pressure line of the inclined-axis variable displacement unit through the selector valve 30 and the flushing-pressure-limiting valve 31, via the pressure channel 32, into an inlet cooling space 34. The function of the selector valve 30 and of the flushing-pressure-limiting valve 31 is explained in more detail hereinbelow.

A central cooling channel 35 connects the inlet cooling space 34 to the discharge space 36. Said central cooling channel 35 runs first of all through the shaft 1, then through the synchronizing articulation 13 and the cylinder block 10, and finally opens out into the discharge space 36 by way of an outlet channel 39.

A coolant guide space 37 likewise connects the inlet cooling space 34 to the discharge space 36. The coolant guide space 37 is bounded by the rolling-contact bearing 2, the housing 4, the pivoting body 5 and the cylinder block 10. The oil passes from the inlet cooling space 34, through the rolling-contact bearings 2 and 3, into the coolant guide space 37. For this connection, however, it is also possible—preferably if slide bearings are used—to provide a separate channel either in the housing 4 or in the shaft 1.

The pivoting body 5 is in the form of a vessel, of which the edge 8 separates the coolant guide space 37 from the discharge space 36 of the housing 4. Part of the interior of the housing 4 comprises walls which are made up of arc segments 7, these arc segments 7 being located in the immediate vicinity of the edges 8 of the pivoting body 5. Located in the vicinity of the base of the pivoting body 5 is an outlet channel 38, which connects the coolant guide space 37 to the discharge space 36.

The better the pivoting body 5 is sealed in relation to the housing 4, the more effective is the cooling of the rolling-contact bearings 2 and 3 and of the cylinder block 10, since, with perfect sealing, the entire oil-mass stream which passes into the coolant guide space is guided directly past the cylinder block 10 and only then passes, through the outlet channel 38, into the discharge space 36. Moreover, the flow from the inlet cooling space 34 to the discharge space 36 is controlled, the oil used as coolant still being at a minimal temperature in the region of the rolling-contact bearings. Mixing with coolant that has already been heated does not take place. It should be emphasized, however, that the invention functions even when no sealing is provided between the pivoting body 5 and the housing 4. In this case, however, the gap between these components should be configured to be as small as possible, e.g. by the edge 8 being positioned as closely as possible to the arc segments 7 of the housing 4.

By virtue of the above described provision of a central cooling channel 35, on the one hand, and of a coolant guide space 37, on the other hand, the oil thus passes over two routes from the inlet cooling space 34 into the discharge space 36. In the inlet cooling space 34, the throughflow divides, in relation to the hydraulic flow resistances of the central cooling channel 35 and of the coolant guide space 37, into two oil-mass streams. A possible pump effect of the bearings is also to be taken into account here, however. The two oil-mass streams combine in the discharge space 36, in which the same pressure level prevails.

En route out of the inlet cooling space into the discharge space, the oil flowing through removes the heat generated from the inclined-axis variable displacement unit. The oil leaves the discharge space 36 through the opening 40 and flows on from there preferably to a cooler.

Supplying oil to the machine in a single hydraulic circuit is the preferred embodiment. However, it is also possible, within the scope of the invention, to provide two hydraulic circuits, of which one is provided in the machine for the conversion into a rotary movement and the other is provided for cooling the machine.

Figure 2:
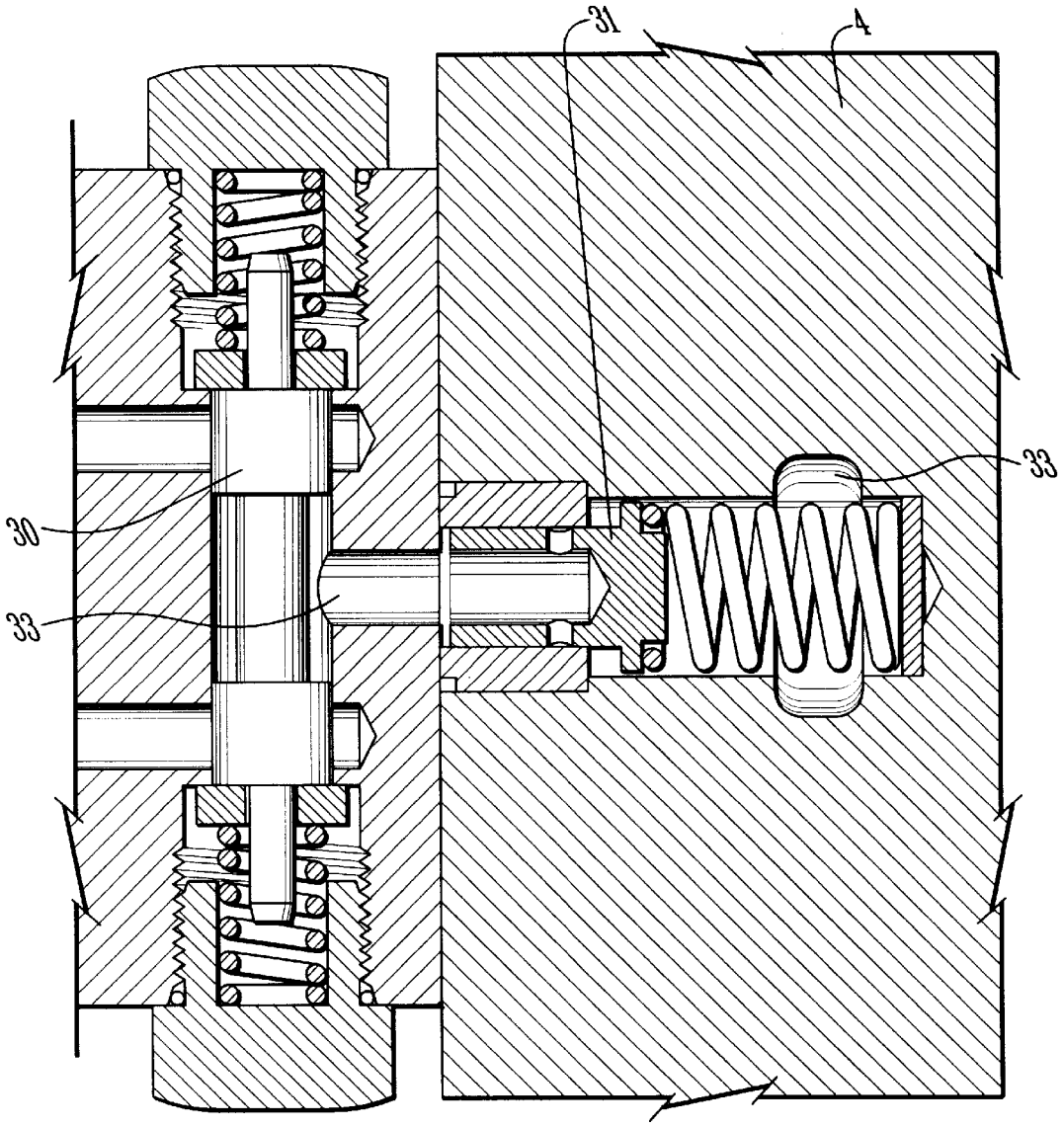
FIG. 2 shows a section through the selector valve and the flushing-pressure-limiting valve.

FIG. 2 shows a cross section through the selector valve 30 and the flushing-pressure-limiting valve 31. The slide within the selector valve 30 is controlled by pressure lines abutting 35 laterally, that is to say at the top and bottom in FIG. 2.

These pressure lines are connected to the inflow and outflow line for the cylinder drum. With a changeover in the pressure conditions in these lines, the desired direction of rotation of the axial piston machine also changes. With such a changeover, the slide is displaced within the selector valve 30, with the result that the pressure channel 33 is always connected to the respective low-pressure line of the axial piston machine.

Figure 3:
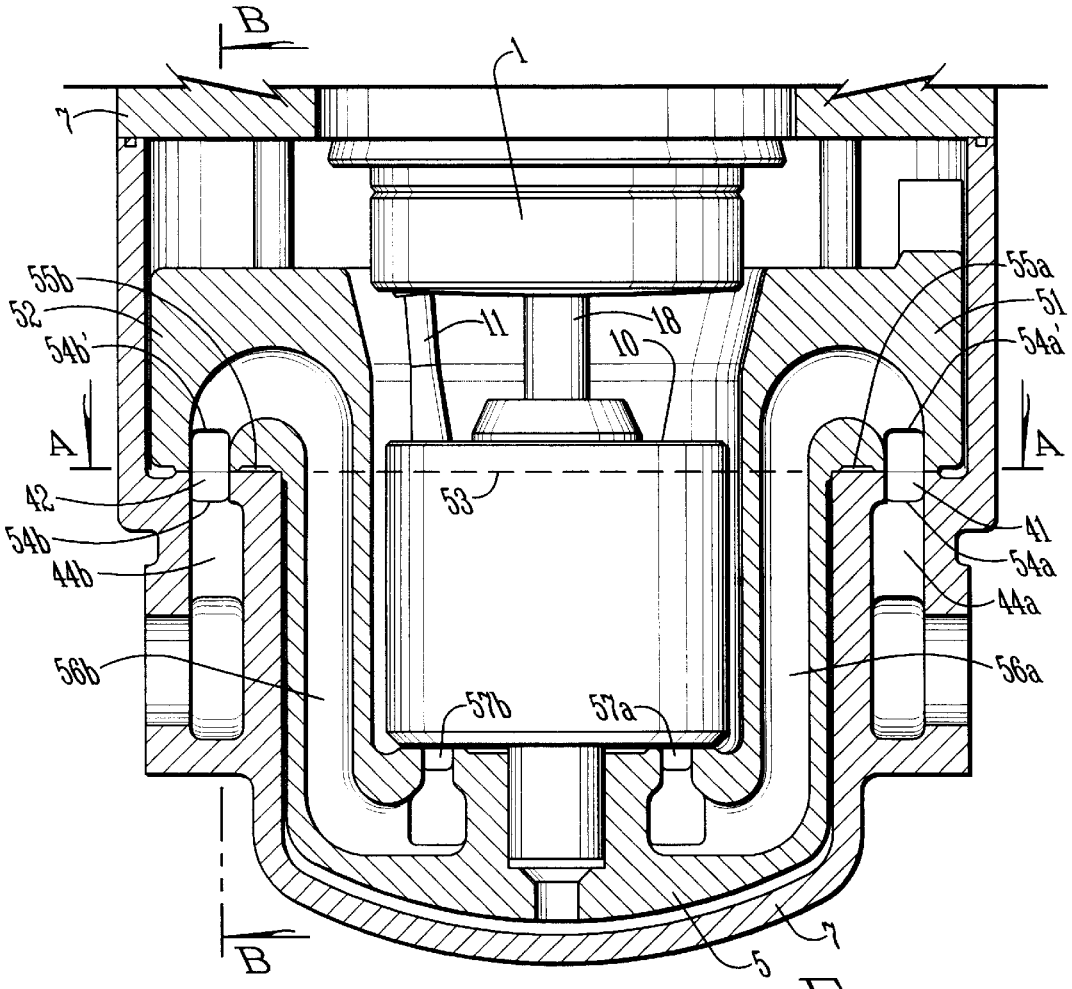
FIG. 3 shows a cross section of the pivoting body perpendicular to the drawing plane according to FIG. 1.

As can be seen in FIG. 3, the pivoting body 5 is subdivided into two symmetrical cylinder segments 51 and 52. These cylinder segments 51 and 52 form an imaginary cylindrical plane 53 which intersects the space in which the working pistons 11 and the cylinder block 10 are mounted.

It can be seen that non-stationary transfer channels 56*a* and 56*b* are arranged in the respective cylinder segments, the top ends of the channels opening out into throughflow chambers 54*a*' and 54*b*'. These throughflow chambers 54*a*' and 54*b*' overlap with throughflow chambers 54*a* and 54*b* in the housing 4, which, in turn, are connected to stationary transfer channels 44*a* and 44*b*. The operating fluid is supplied and discharged via these channels 44*a* and 44*b*, depending on the direction of rotation of the shaft.

The plane of the hydrostatic slide mounting for the pivoting body 5, which coincides with the imaginary cylinder plane 53, is thus located in the region of said throughflow chambers 54*a*, 54*b*, 54*a*' and 54*b*'.

Figure 4:
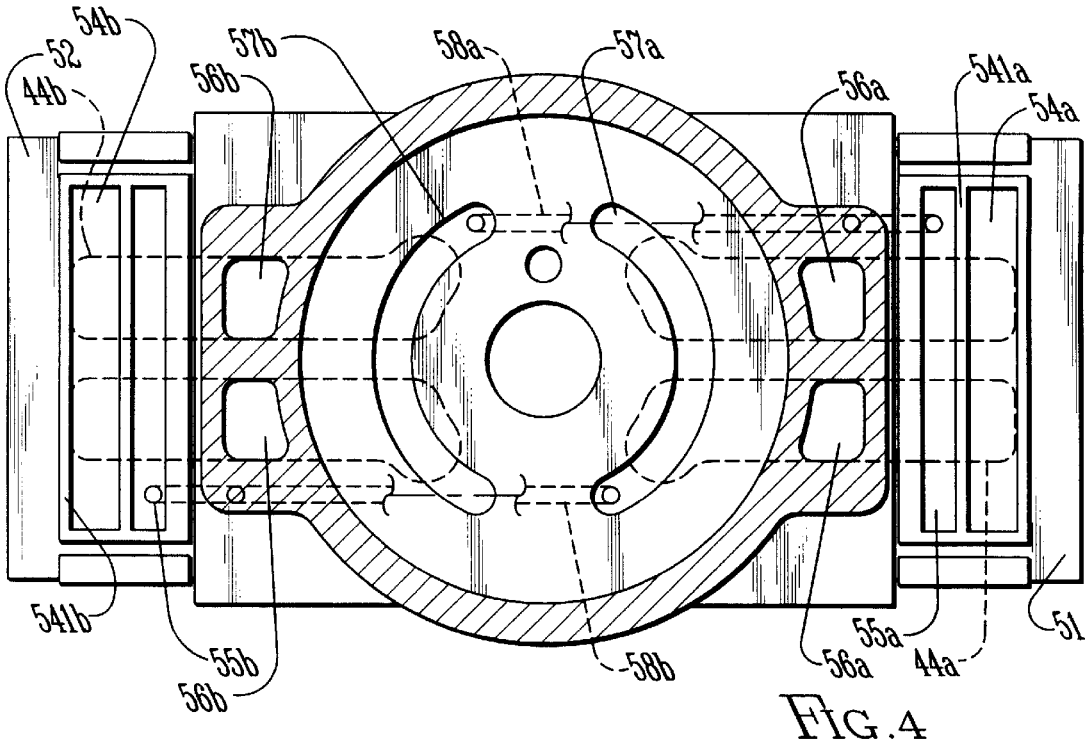
FIG. 4 shows a section along line A—A according to FIG. 3.

FIG. 4 represents a sectional illustration along line A—A according to FIG. 3, i.e. along the cylinder plane 53. In this view, it is possible to see the corresponding openings of the non-stationary transfer channels 56*a* and 56*b*, the openings of the stationary transfer channels 44*a* and 44*b* and the throughflow chambers 54*a* and 54*b*. These throughflow chambers 54*a* and 54*b* extend, transversely to the openings of the respective transfer channels, over more or less the entire length of the cylinder segments 51 and 52. In order to compensate as advantageously as possible for the forces acting on the pivoting body 5, the cylinder segments 51 and 52 are provided with corresponding compensation chambers 55*a* and 55*b*. The compensation chambers 55*a* and 55*b*, like the throughflow chambers 54*a* and 54*b*, are enclosed by corresponding sealing zones 541*a* and 541*b*. According to the invention, the compensation chamber 55*a* is connected to the circle-segment channel 57*b* via a connecting channel 58*a*, while the compensation chamber 55*b* is connected to the circle-segment channel 57*a* via a corresponding connecting channel 58*b*.

The pressure signal is then fed to said compensation chambers 55*a* and 55*b*, via the connecting channels 58*a* and 58*b*, from the non-stationary transfer channels 56*b* and 56*a* on the opposite side of the pivoting body 5.

Since the diameter of the cylinder segments 51 and 52 in the configuration according to the present invention is considerably smaller than the respective configurations from the prior art, the length of that stretch which each point of the imaginary cylindrical plane 53 has to cover during adjustment of the pivoting body 5 is also shorter. It is thus always possible to provide a sufficient throughflow width for the throughflow chambers 54*a* and 54*b*. At the same time, it is possible to mount the pivoting body 5 in the stationary part of the housing 4 in the vicinity of the separating plane 45 of the housing 4. In this way, the vibrations of the housing 4 which occur on account of the cyclic loading of the pivoting body 5, can be reduced to a considerable extent. As can be seen in FIG. 2, the end side 21 of the rolling-contact bearing 2 is thus located in the separating plane 45 of the housing 4.

Figure 5:
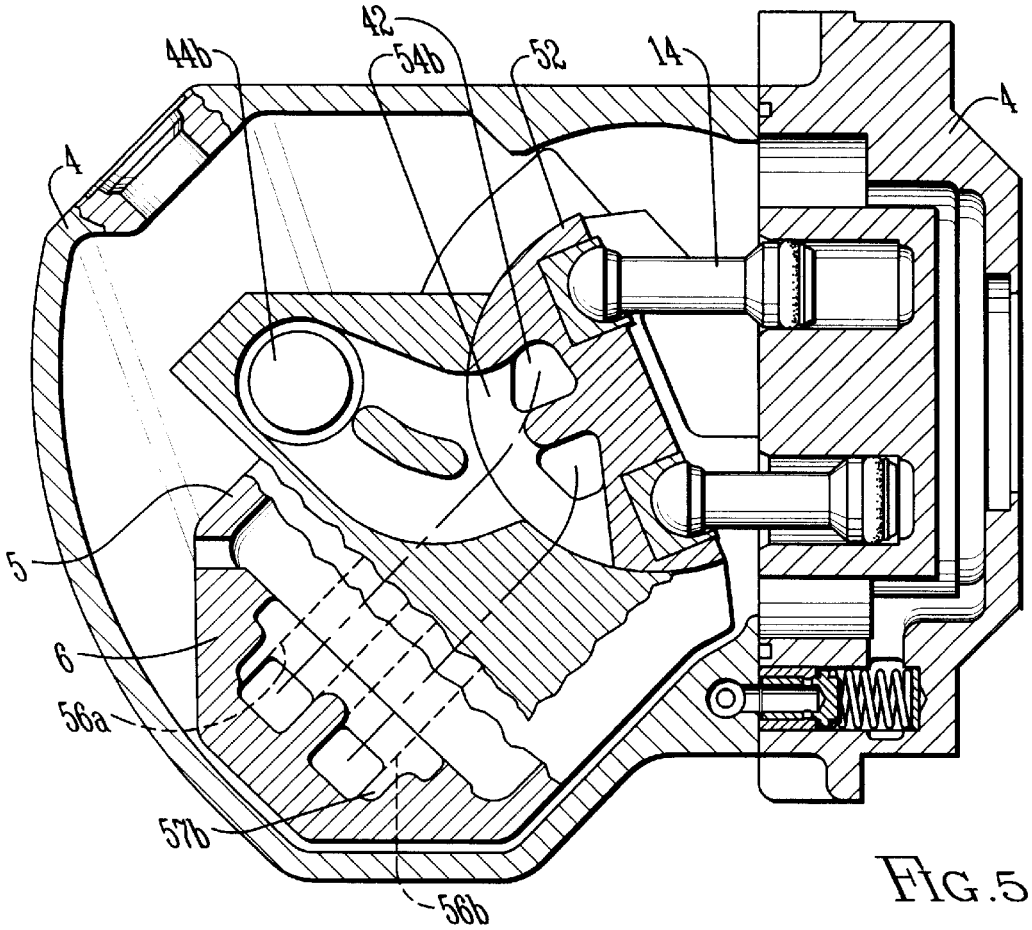
FIG. 5 shows a section along line B—B according to FIG. 3.

FIG. 5 shows a section along B—B according to FIG. 3, i.e. a section through the left-hand cylinder segment 52 and the corresponding portion of the housing 4. The latter has the stationary transfer channel 44*b*, which then opens out into the throughflow chamber 54*b*. The cylinder segment 52 is mounted for hydrostatic sliding action in the hollow 42, while the opposite end is connected to the stationary part of the housing 4 by axially displaceable pins 14. The circle-segment channel 57*b* is arranged in the base 6 of the pivoting body 5. In the exemplary embodiment shown here, the non-stationary transfer channel 56*b*, which connects the segment channel 57*b* to the throughflow chamber 54*b*, is configured by two parallel channels.

The vessel-like form of the pivoting body allows the coolant stream to be guided past the cylinder block in a controlled manner. It is possible here for the pivoting body, which may be configured in one or more parts, to engage either fully or just partially around the cylinder block and to have openings on its base, and on its side walls.

Dividing up the interior of the housing into a coolant guide space and into a discharge space prevents the low-temperature coolant from being mixed prematurely with the already heated coolant, as is the case, for example in the configuration described in Patent DE-A-198 29 060. The temperature distribution of the coolant from the inlet cooling space, via the coolant guide space, to the discharge space is thus favorably influenced and largely pre-determined.

It is therefore seen that this invention will achieve its principal objective.

| List of designations | |
|---|---|
| 1 | Output shaft |
| 2 | First rolling-contact bearing |
| 3 | Second rolling-contact bearing |
| 4 | Housing |
| 5 | Pivoting body |
| 6 | Base of the pivoting body |
| 7 | Arc-segment-like inner surfaces |
| 8 | Edge |
| 10 | Cylinder block |
| 11 | Working piston |
| 12 | Cylinder openings in the cylinder block |
| 13 | Synchronizing articulation |
| 14 | Pin |
| 21 | End side of the first rolling-contact bearing |
| 30 | Selector valve |
| 31 | Flushing-pressure-limiting valve |
| 32 | Channel |
| 33 | Pressure channel |
| 34 | Inlet cooling space |
| 35 | Central cooling channel |
| 36 | Discharge space |
| 37 | Coolant guide space |
| 38 | First outlet channel |
| 39 | Second outlet channel |
| 40 | Opening |
| 41, 42 | Hollows |
| 44a, 44b | Stationary transfer channels |
| 45 | Separating plane of the housing |
| 51, 52 | Cylinder segments |
| 53 | Imaginary cylinder plane |
| 54a, 54b | Throughflow chambers in the housing |
| 54a', 54b' | Throughflow chambers in the pivoting body |
| 55a, 55b | Compensation chambers |
| 56a, 56b | Non-stationary transfer channels |
| 57a, 57b | Circle-segment channels |
| 58a, 58b | Connecting channels |
| 541a, 541b | Sealing zones |

We claim:

1. An inclined-axis variable displacement unit comprising an output shaft (1), mounted in a housing (4), and a cylinder block (10), the cylinder block (10) being connected to the output shaft (1) via a synchronizing articulation (13), and via working pistons (11) which can be displaced in the cylinder block (10), and being mounted in a pivoting body (5), which can be pivoted in relation to the axis of the output shaft, characterized in that the pivoting body (5) is in the form of an open vessel, the cylinder block (10) being arranged in the opening of the pivoting body (5), wherein the pivoting body (5) has one or more first outlet channels (38) which connect a coolant guide space (37) and a discharge space (36) to one another.

2. The inclined-axis variable displacement unit according to one of claim 1, characterized in that the first outlet channel or channels (38) is/are arranged in the region of the base of the vessel-like pivoting body (5).

3. The inclined-axis variable displacement unit according to claim 1, characterized in that part of the housing (4) has one or more inner surfaces (7) which is/are located in the immediate vicinity of the edge (8) of the opening of the vessel-like pivoting body (5).

4. The inclined-axis variable displacement unit according to claim 1, characterized in that at least one inner surface (7), which is located in the immediate vicinity of the edge (8) of the opening of the vessel like pivoting body (5), has an arc-segment shape.

5. The inclined-axis variable displacement unit according to claim 1, characterized in that the pivoting body (5) is mounted for hydrostatic sliding action in the housing (4).

6. The inclined-axis variable displacement unit according to claim 1, characterized in that the pivoting body (5) is formed in one or more pieces.

7. The inclined-axis variable displacement unit according to claim 1, characterized in that the pivoting body (5) engages fully or partially around the cylinder block (10).

8. The inclined-axis variable displacement unit according to claim 1, characterized in that an inlet cooling space (34) is located on a side of the mounting of the output shaft (1) which is directed away from the cylinder block (10).

9. The inclined-axis variable displacement unit according to claim 1, characterized in that the inlet cooling space (34) is connected to the coolant guide space (37).

10. The inclined-axis variable displacement unit according to claim 1, characterized in that there is provided a central cooling channel (35) which connects the inlet cooling space (34) and the discharge space (36) to one another.

11. The inclined-axis variable displacement unit according to claim 1, characterized in that a central cooling channel (35) runs through the synchronized articulation (13) and the cylinder block (10).

12. The inclined-axis variable displacement unit according to claim 1, characterized in that a central cooling channel (35) runs through the output shaft (1).

13. The inclined-axis variable displacement unit according to claim 1, characterized in that a selector valve (30) is adapted to allow passage of oil into the interior of the housing.

14. The inclined-axis variable displacement unit according to claim 1, characterized in that a low-pressure branch of the main circuit of said unit is adapted to allow coolant circulation.

15. The inclined-axis variable displacement unit according to claim 1, characterized in that a flushing pressure-limiting valve (31) is adapted to allow coolant circulation.

16. An inclined-axis variable displacement unit comprising an output shaft (1), mounted in a housing (4), and a cylinder block (10), the cylinder block (10) being connected to the output shaft (1) via a synchronizing articulation (13), and via working pistons (11) which can be displaced in the cylinder block (10), and being mounted in a pivoting body (5), which can be pivoted in relation to the axis of the output shaft, characterized in that the pivoting body (5) is in the form of an open vessel, the cylinder block (10) being arranged in the opening of the pivoting body (5), wherein the pivoting body (5) divides up the interior of the housing into a coolant guide space (37) and a discharge space (36) having an opening (40), the coolant guide space (37) being bounded on the one hand by the interior of the pivoting body (5) and, on the other hand by the mounting of the output shaft (1), wherein the discharge space (36) is adapted to direct oil from the coolant guide space (37) to the opening (40).

17. An inclined-axis variable displacement unit comprising an output shaft (1), mounted in a housing (4), and a cylinder block (10), the cylinder block (10) being connected to the output shaft (1) via a synchronizing articulation (13), and via working pistons (11) which can be displaced in the cylinder block (10), and being mounted in a pivoting body (5), which can be pivoted in relation to the axis of the output shaft, characterized in that the pivoting body (5) is in the form of an open vessel, the cylinder block (10) being arranged in the opening of the pivoting body (5), wherein a central cooling channel (35) opens out into the discharge space (36) by way of a second outlet channel (39), which is arranged in the pivoting body (5).

* * * * *